United States Patent [19]

Markey et al.

[11] 4,206,589

[45] Jun. 10, 1980

[54] FORMATION OF A SELF TWIST FIBROUS STRUCTURE

[75] Inventors: John J. Markey, Rossendale; William M. Farnhill, Burnley, both of England

[73] Assignee: Platt Saco Lowell Limited, United Kingdom

[21] Appl. No.: 959,406

[22] Filed: Nov. 9, 1978

[30] Foreign Application Priority Data

Nov. 9, 1977 [GB] United Kingdom ..... 46575/77

[51] Int. Cl.[2] ..... D01H 7/90; D01H 7/92; D02G 3/26

[52] U.S. Cl. ..... 57/293; 57/350

[58] Field of Search ..... 57/293, 294, 331, 333, 57/350

[56] References Cited

U.S. PATENT DOCUMENTS

| | | | |
|---|---|---|---|
| 3,225,533 | 12/1965 | Henshaw | 57/331 X |
| 3,443,370 | 5/1969 | Walls | 57/331 X |
| 3,775,955 | 12/1973 | Shah | 57/333 X |
| 4,055,039 | 10/1977 | Movshovich et al. | 57/350 X |
| 4,055,040 | 10/1977 | Lin | 57/293 X |
| 4,068,459 | 1/1978 | Movshovich et al. | 57/293 |
| 4,074,511 | 2/1978 | Chambley et al. | 57/333 X |
| 4,084,400 | 4/1978 | Movshovich et al. | 57/293 |

*Primary Examiner*—John Petrakes

*Attorney, Agent, or Firm*—Donald H. Feldman

[57] ABSTRACT

A method of forming a self-twisted fibrous structure comprises twisting two strands of similar count such that each has repeated along its length alternating zones of opposite twist, converging the strands at a convergence point such that they partly untwist around one another to form a self-twisted structure and acting on the strands at or downstream of the convergence point by applying further alternating zones of opposite twist so as to modify the strand to ply twist ratio of the structure. The further twist is applied at a point not greater than one half cycle length from the first twist point and at a phase difference 20° to 60° following.

4 Claims, 1 Drawing Figure

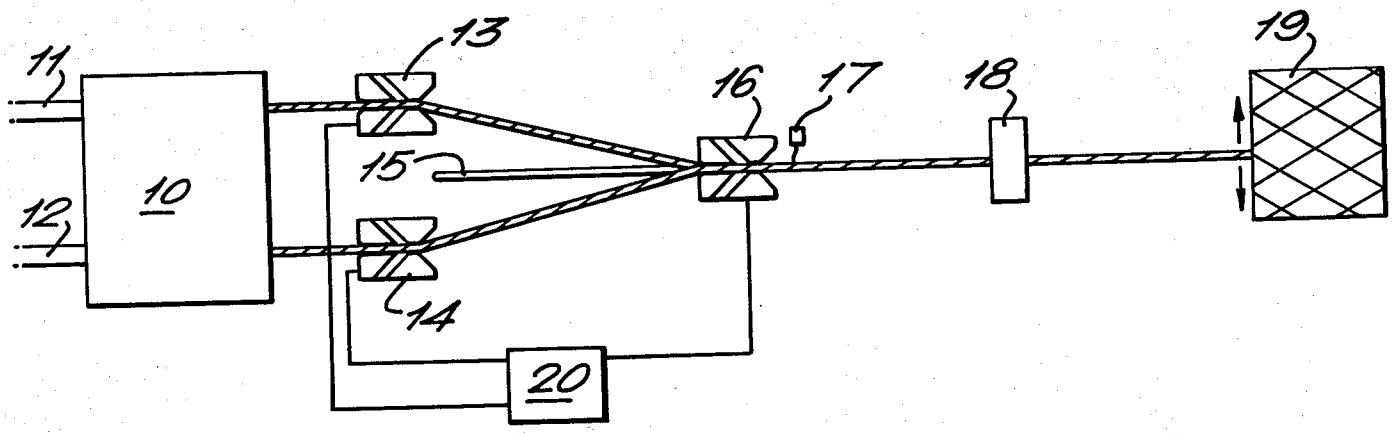
19
18
17
16
13
15
14
20
10
11
12

FORMATION OF A SELF TWIST FIBROUS STRUCTURE

BACKGROUND OF THE INVENTION

This invention relates to the formation of a Self-twist fibrous structure from two or more strands of similar count.

In British Pat. No. 1,015,291 is disclosed a method of forming what has become known as a self-twist yarn by the introduction into one or both of two strands alternating zones of opposite twist along the length of the strands and then converging the strands so that the or each twisted strand partly untwists around the other strand to form a stable self-twisted fibrous structure having alternate zones of opposite ply twist with some strand twist remaining in the or each twisted strand. This method may be applied either to two strands of similar count wherein generally both strands are twisted or to such a strand in combination with a much finer filament strand in which case only the coarse strand is twisted since twisting of the filament strand makes effectively no alteration to the structure of the finalised yarn.

The present invention is concerned only with the formation of a self-twist structure from strands of similar count and in this context "similar" means strands having counts such that when both are twisted the twist of each contributes effectively to the resultant structure. The invention can also be applied to structures having more than two strands particularly three-fold structures.

Since the development of self-twist structures in 1961 when the above patent was filed and during the time that these structures have been commercially used, that is since approximately 1969, it has always been accepted that when two strands of similar count are twisted and allowed to converge they will assume a natural balance of ply twist to remaining strand twist in the resultant self-twist structure and that this natural balance is unalterable. Clearly the natural balance is dependent upon the type of fibres employed, the coarseness of the strand and other factors in this complex twisting arrangement but it has always been held that such a balance or ratio is a natural and fundamental property of the strands and can either be calculated or determined by experiment and will be repeatable in all reconstructions of the twisted structure from the same strands or strands having the same properties.

It has been appreciated that this natural balance can in some circumstances and particularly with coarser yarns cause severe difficulties in that the remaining strand twist may be too high for a particular required ply twist thus causing the strands to appear very lean and rendering them totally unsatisfactory for commerical use.

SUMMARY OF THE INVENTION

It is an object of this invention to provide an apparatus and method for forming a self-twist fibrous structure in which the strand to ply twist ratio can be modified to allow formation of yarns suitable for more end uses.

The invention provides, according to a first aspect, a method of forming a self-twisted fibrous structure from two strands of similar count, comprising twisting the strands such that each has introduced along its length alternate zones of opposite twist, converging the strands at a convergence point such that they partly untwist around one another to form a self-twisted structure having alternate zones of opposite ply twist and some remaining strand twist in each of the converged strands, wherein the improvement comprises acting upon the strands so as to modify the balance of strand twist to ply twist conventionally found in a self-twisted structure of the strands.

Preferably the strands are acted upon at or downstream of the convergence point and more preferably by applying alternating zones of opposite twist to the converged strands at or downstream of the convergence point, preferably at the same frequency as the first twist.

In a particularly preferred embodiment the further twist is applied at a distance no greater than one half cycle length from the point of application of the first twist, and the phase of the further twist is chosen in the range 20° to 60° after that of the first twist.

According to a second aspect of the invention there is provided an apparatus for forming a self-twisted fibrous structure from two strands of similar count, comprising first twisting means for twisting the strands such that each has introduced along its length alternate zones of opposite twist, guiding means for guiding the strands such that they converge at a convergence point and partly untwist around one another to form a self-twisted structure having alternate zones of opposite ply twist and some remaining strand twist in each of the converged strands, and means for acting upon the strands so as to modify the natural balance of strand twist to ply twist conventionally found in a self-twisted structure of the strands. Preferably the acting means is arranged to act on the strands at or downstream of the convergence point.

DESCRIPTION OF THE PREFERRED EMBODIMENT

The invention will become more apparent from the following description when taken in conjunction with the accompanying drawing which shows schematically an apparatus for forming a self-twisted fibrous structure.

The apparatus is shown only schematically and comprises a drafting system 10 of conventional form, receiving and drafting two strands 11 and 12 from a creel (not shown). The drafted strands issuing from the drafting system 10 separately enter vortex twisting units 13 and 14 shown again only schematically. Reference is made to prior U.S. patent application Ser. No. 944,099, filed Sept. 20, 1978, which shows in detail the arrangements of the vortex twisting units 13 and 14 together with apparatus for supplying air at the correct frequency and phase thereto. Downstream of the units 13 and 14 a plate 15 extends symmetrically between the two strands and serves to keep them separate prior to entering a further vortex twisting unit 16 of the same form as the units 13 and 14 and is more fully described both in detail and in operation in the aforementioned application. A control device 20 acts to control the supply of air to the units 13, 14 and 16 and is of the form more fully disclosed particularly in FIGS. 8 and 9 of the aforementioned application. Downstream of the unit 16 a filament insertion device 17 is located to apply a monofilament to the twisted structure issuing from the unit 16 to wrap therearound. The device 17 may in other arrangements be omitted if the wrapping of a filament is not required. Nip rollers 18 and a wind-up unit 19 serve to package the formed twisted structure for subsequent use, nip rollers 18 separating winding tension from the twisting zones in conventional manner.

In operation the strands issuing from the drafting system 10 pass through the units 13 and 14 and are twisted thereby in phase by the introduction along their length of alternate zones of opposite twist. The cycle length controlled by the device 20 may lie in the range 20 to 100 cms. but the preferred cycle length is of the order of 60 cms.

The twisted strands emerging from the units 13 and 14 are maintained separate by the plate 15 in order to prevent their premature convergence and in order to provide an unsupported path length of the twisted strands up to the convergence point whose position is located by the end of the plate 15 and the entry into the unit 16.

At the convergence point the strands partly untwist around one another to form a stable self-twist structure having alternate zones of opposite ply twist and leaving some strand twist remaining in the strands. The unit 16 is controlled by the device 20 to introduce into the converged strands a further twist of alternating zones of opposite twist of the same frequency as the twist introduced by the units 13 and 14 but at a phase difference therefrom.

The twist introduced by the unit 16 thus runs back in the converged strands to the convergence point and in some way which cannot presently be explained modifies the formation of the self-twist structure so that it is formed with a strand to ply twist ratio or balance which is different from the natural balance.

To achieve the maximum benefit from this effect the spacing between the units 13, 14 and the unit 16 should not be greater than one half cycle length. The phase difference between the units 13, 14 and the unit 16 alters the modification of the self-twist formation. To achieve maximum reduction in remaining strand twist the phase difference should lie in the range 20° to 60° with the unit 16 following or more preferably in the range 30° to 50°. However other phase differences may be used in order to maximise remaining strand twist should this be required in some particular structures.

In an alternative arrangement (not shown) the convergence point is controlled by the plate 15 and a guide (not shown) such that the strands converge some distance prior to the entry into the unit 16.

The unit 16 therefore acts upon the strands at or downstream of the convergence point so as to modify the formation of the self-twist structure and thereby to modify the balance of strand twist to ply twist conventionally found in a self-twist structure of the strands, that is the natural balance. The twist inserted by the unit 16 is allowed to run freely back to the convergence point.

The following examples will serve to illustrate the substantial modification of the self-twist structure that occurs with the present invention. In the examples "conventional" refers to two-fold doubled carpet yarn formed in the conventional manner by ring twisting to form singles yarn and the ring doubling to form a two fold structure. "S.T." refers to yarns formed using the conventional self-twist formation technique and "modified S.T." refers to yarns formed according to the present invention. Specifically the yarns formed according to the present invention were formed on an apparatus as shown in the accompanying drawing wherein the distance between the units 13, 14 and the unit 16 was one half cycle length and the phase difference was 30°. The yarns were formed from 100% acrylic, 17 D tex, 150 mm. staple length fibre.

Twist measured in turns/meter.

| | Introduced Singles twist. | Ply twist. | Residual Singles twist. | Ratio of introduced singles twist to ply twist |
|---|---|---|---|---|
| EXAMPLE 1 | | | | |
| Conventional | 100 | 80 | 20 | 1.25 |
| S.T. | 133 | 76 | 57 | 1.75 |
| Modified S.T. | 108 | 80 | 28 | 1.35 |
| EXAMPLE 2 | | | | |
| Conventional | 160 | 115 | 45 | 1.39 |
| S.T. | 204 | 113 | 91 | 1.80 |
| Modified S.T. | 167 | 113 | 54 | 1.47 |
| EXAMPLE 3 | | | | |
| Conventional | 200 | 135 | 65 | 1.48 |
| S.T. | 251 | 132 | 119 | 1.90 |
| Modified S.T. | 209 | 135 | 74 | 1.54 |

Example 1 concerns a yarn suitable for low cut pile carpet. Example 2 concerns yarn suitable for loop pile carpet and Example 3 concerns yarn suitable for heat set shag pile carpet. In all instances the conventional yarn is entirely suitable and has been employed for many years.

The S.T. and Modified S.T. structures are attempts to copy the parameters of the conventional yarn, with the vastly increased speeds available by the Self-twist formation method.

It is clear that the S.T. yarns are very different from the conventional yarns and thus are not commercially acceptable whereas the yarns formed according to the present invention approach very closely the required paramters.

Particularly reference should be made to the residual twist in the strands wherein clearly the twist levels of the S.T. yarns are very high and will produce a very tight, lean yarn which will not look attractive or give the required cover. In one case the Modified S.T. yarn has a strand twist level of less than one half of the S.T. yarn. It will be appreciated that this makes a major difference to the appearance of the yarn.

We claim:

1. In an apparatus for forming a self-twisted fibrous structure, comprising first twisting means for twisting each of two strands of similar count in parallel array so as to impart along its length alternate zones of opposite twist and second twisting means for receiving both strands of alternately twisted strands as a plied structure and for imparting to said plied structure further alternating zones of opposite twist along the length thereof, the improvement comprising control means for controlling the point of convergence of said two strands of alternately zoned twisted structure intermediate said first and second twisting means such that said point of convergence is at most one-half cycle length from said first twisting means, and for controlling said further alternate zones of opposite twist imparted to said plied structure such that they are of equal frequency to those imparted by said first twisting means but that such frequency is out of phase with said frequency imparted by said first twisting means within the range of from 20° to 60°.

2. The improvement as in claim 1, wherein said control means includes a separator plate which is interposed between said two strands from where they leave said first twisting means to where said strands converge.

3. The improvement as in claim 1, wherein said control means for controlling said further alternate zones is means for controlling said frequency imparted by said second twisting means such that it is out of phase with said frequency imparted by said first twisting means within the range of from 30° to 50°.

4. The improvement as in claim 1, wherein said control means controls said point of convergence such that it occurs immediately adjacent said second twisting means.

* * * * *